US011214462B2

(12) United States Patent
Pedoeem et al.

(10) Patent No.: US 11,214,462 B2
(45) **Date of Patent: *Jan. 4, 2022**

(54) CABLE RETRACTOR

(71) Applicant: Crestron Electronics, Inc., Rockleigh, NJ (US)

(72) Inventors: Albert Pedoeem, West Orange, NJ (US); Kriss Replogle, Brookside, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 250 days.

This patent is subject to a terminal disclaimer.

(21) Appl. No.: 16/698,155

(22) Filed: Nov. 27, 2019

(65) Prior Publication Data

US 2020/0109024 A1 Apr. 9, 2020

Related U.S. Application Data

(63) Continuation of application No. 15/857,418, filed on Dec. 28, 2017, now Pat. No. 10,549,946.

(51) Int. Cl.
*B65H 75/48* (2006.01)
*B65H 75/44* (2006.01)

(52) U.S. Cl.
CPC ..... *B65H 75/48* (2013.01); *B65H 75/446* (2013.01); *B65H 75/4431* (2013.01); *B65H 75/4449* (2013.01); *B65H 75/4471* (2013.01); *B65H 75/4484* (2013.01); *B65H 2701/3919* (2013.01)

(58) Field of Classification Search
CPC .... H02G 11/00; H02G 11/003; H02G 11/006; H02G 11/02; B65H 75/00; B65H 75/18; B65H 75/34; B65H 75/48; B65H 75/4431; B65H 75/4449; B65H 75/446; B65H 75/4471; B65H 75/4484; B65H 2701/3919
See application file for complete search history.

(56) References Cited

U.S. PATENT DOCUMENTS

| | | | |
|---|---|---|---|
| 2,159,004 | A | 5/1939 | Bosch, Jr. |
| 2,619,665 | A | 12/1952 | Hopkins et al. |
| 2,922,861 | A | 1/1960 | White |
| 3,049,317 | A | 8/1962 | Kessler |
| 3,480,227 | A | 11/1969 | Matthews |
| 3,657,491 | A | 4/1972 | Ryder et al. |
| 3,773,987 | A | 11/1973 | Davis et al. |
| 3,809,331 | A | 5/1974 | Gaul |

(Continued)

OTHER PUBLICATIONS

Extron, Cable Cubby Series 2, Mar. 2016, 68-2604-01, Rev. C, available at www.extron.com/download/files/brochure/cable_cubby_series_2_verA4.pdf.

(Continued)

*Primary Examiner* — Robert J McCarry, Jr.
(74) *Attorney, Agent, or Firm* — Crestron Electronics, Inc.

(57) ABSTRACT

A cable retractor includes a housing. A spool is disposed within the housing and is mechanically coupled to the housing and rotatable about an axis. A spring mechanism is operatively attached to the spool and is configured to urge the spool to rotate in a first rotational direction about the axis. An electricity operated rotation regulator is operatively attached to the spool and is configured to, when activated, prevent the spool from rotating in the first rotational direction.

13 Claims, 13 Drawing Sheets

(56) References Cited

U.S. PATENT DOCUMENTS

| | | | |
|---|---|---|---|
| 3,958,396 | A | 5/1976 | Keiley et al. |
| 4,366,577 | A | 12/1982 | Brandt |
| 4,419,641 | A | 12/1983 | Slavin et al. |
| 4,722,494 | A | 2/1988 | Fairchild |
| 4,901,938 | A | 2/1990 | Cantley et al. |
| 5,255,768 | A | 10/1993 | Kasper et al. |
| 5,279,473 | A | 1/1994 | Rozon |
| 5,421,530 | A | 6/1995 | Bertagna et al. |
| 5,453,585 | A | 9/1995 | Lenz et al. |
| 5,507,446 | A | 4/1996 | Ditzig |
| 5,520,350 | A | 5/1996 | Doty et al. |
| 5,590,746 | A | 1/1997 | Brotz |
| 5,590,749 | A | 1/1997 | Wagner et al. |
| 5,671,833 | A | 9/1997 | Edwards et al. |
| 5,746,389 | A | 5/1998 | Willmann |
| 5,957,399 | A | 9/1999 | Siana, Jr. |
| 6,086,007 | A | 7/2000 | Till |
| 6,143,985 | A | 11/2000 | Knapp et al. |
| 6,234,417 | B1 | 5/2001 | Sauder et al. |
| 6,375,109 | B1 | 4/2002 | Liao |
| 6,483,033 | B1 | 11/2002 | Simoes et al. |
| 6,484,958 | B1 | 11/2002 | Xue et al. |
| 7,364,109 | B2 | 4/2008 | Kuo |
| 7,438,258 | B2 | 10/2008 | Chen |
| 7,900,759 | B2 | 3/2011 | Kim et al. |
| 8,336,688 | B2 | 12/2012 | Chen et al. |
| 8,469,303 | B2 | 6/2013 | Feldstein et al. |
| 8,469,304 | B2 | 6/2013 | Feldstein et al. |
| 8,469,305 | B2 | 6/2013 | Feldstein et al. |
| 8,720,657 | B2 | 5/2014 | Kramer et al. |
| 8,740,127 | B2 | 6/2014 | Soper et al. |
| 9,056,744 | B2 | 6/2015 | Feldstein et al. |
| 9,272,876 | B2 | 3/2016 | Draganovic et al. |
| 9,309,087 | B2 | 4/2016 | Laube et al. |
| 9,352,932 | B2 | 5/2016 | Soper |
| 9,425,563 | B2 | 8/2016 | Laube et al. |
| 9,553,413 | B2 | 1/2017 | Laube et al. |
| 9,680,262 | B2 | 6/2017 | Laube et al. |
| 10,549,946 | B2 * | 2/2020 | Pedoeem ..... B65H 75/4471 |
| 2004/0035971 | A1 | 2/2004 | Li |
| 2006/0006038 | A1 | 1/2006 | Beverlin |
| 2007/0023557 | A1 | 2/2007 | Rankin |
| 2008/0156922 | A1 | 7/2008 | Rabinowitz et al. |
| 2012/0262115 | A1 * | 10/2012 | Ichikawa ..... H02G 11/02 320/109 |
| 2014/0374531 | A1 * | 12/2014 | Laube ..... B65H 75/44 242/611.1 |

OTHER PUBLICATIONS

FSR Inc., Table Boxes, LIT1187H, 2014, available at www.novotech.com.mx/wp-content/uploads/2016/03/1187H-Table-Box-Brochure.pdf.

Kramer Electronics Ltd., K-Able/XL Box Cable Retractor, User Manual, P/N: 2900-300441 Rev 3, 2015, available at k.kramerav.com/downloads/manuals/k-able_xl_box.pdf.

Legrand, WIREMOLD® Table Boxes, ED1706R5—Updated Mar. 2016 , available at www.legrand.us/wiremold.aspx.

Legrand, WIREMOLD®, InteGreat™ A/V Table Box, ED1699R1 0913, 2013, available at www.legrand.us/wiremold.aspx.

Legrand, WIREMOLD® Table Boxes, ED1652R3—Updated Apr. 2016, available at www.legrand.us/wiremold.aspx.

* cited by examiner

CABLE RETRACTOR

CROSS-REFERENCE TO RELATED APPLICATIONS

This application is a continuation of U.S. application Ser. No. 15/857,418, filed Dec. 28, 2017, the disclosure of which is incorporated herein by reference.

BACKGROUND OF THE INVENTION

Technical Field

The present embodiments relate to a device for storing, withdrawing, and retracting a cable and, more particularly, to cable retractors that facilitate the controlled withdrawal and retraction of a cable.

Background Art

In many applications, it is desirable to provide power and data connections to different electrical or electronic devices using cables which may be dispensed when needed and then withdrawn when no longer needed. For example, many business and academic environments include conference rooms in which meetings are held where the participants bring laptop or notebook computers, video projectors or other devices that require various data connections. It is desirable that the conference room or similar facility be configured to deliver these services by providing cables which are connectable to the various devices. It further desired that such cables can be stowed away out of sight when they are no longer needed after the meeting.

Various apparatuses are known which can provide such cable connections. As an example, tabletop enclosures may be provided that are recessed in an opening in the conference table or other work surface and which have a housing that extends below surface of the tabletop. The connector end of the cable is accessible from within the enclosure and the rest of the cable may be stored in a device, such as a cable retractor, that permits the cable to be pulled out from the enclosure when needed and then retracted after use.

Many of the known types of cable retractors permit the entire length of the cable to be pulled out but not do not allow for only a portion of the length to be withdrawn. A locking mechanism may be provided that locks the cable in place when the cable is fully extended and which may be unlocked subsequently after use. Alternatively, an external locking mechanism may be provided at a location in the enclosure by which the cable may be manually held in place after being withdrawn and which must later be manually unlocked to retract the cable.

Other known cable retractors permit the cable to be partially pulled out but only at predetermined lengths. These cable retractors typically employ complex ratchet mechanisms or other mechanisms that can lock the cable at one of the predefined lengths. Such ratchet mechanisms often require that, after use, the cable must be fully pulled out in order to release the ratchet mechanism and retract the cable. Moreover, because the cable can only be withdrawn to predefined lengths, repeated pulling out and retraction of the cable may be required by a user until the cable is pulled out to the length desired.

It is therefore desirable to provide an improved cable retractor that permits the cable to be pulled out to any length within a continuous range of lengths. It is further desirable to provide an improved cable retractor which holds the cable in place and later permits the cable to be retracted without using a complex mechanism.

SUMMARY OF THE INVENTION

It is to be understood that both the general and detailed descriptions that follow are exemplary and explanatory only and are not restrictive.

DISCLOSURE OF INVENTION

In accordance with an aspect, a cable retractor comprises (a) a housing; (b) a spool, disposed within the housing, that is mechanically coupled to the housing and rotatable about an axis; (c) a spring mechanism operatively attached to the spool and configured to urge the spool to rotate in a first rotational direction about the axis; and (d) an electrically operated rotation regulator operatively attached to the spool and configured to, when activated, prevent the spool from rotating in the first rotational direction.

According to another aspect, a cable retractor comprises (a) a housing; (b) a spool, disposed within the housing, that is mechanically coupled to the housing and rotatable about an axis; (c) a spring mechanism operatively attached to the spool and configured to urge the spool to rotate in a first rotational direction about the axis; (d) a one-way bearing coupled to the spool and configured to rotate only in a second rotational direction about the axis that is opposite to the first rotational direction; (e) a shaft coupled at one end to the one-way bearing; and (f) an electromagnetic clutch coupled to the housing and configured to, when activated, engage an opposing end of the shaft whereby the one-way bearing prevents the spool from rotating in the first rotational direction.

According to yet another aspect, a cable retractor comprises (a) a housing; (b) a spool, disposed within the housing, that is mechanically coupled to the housing and rotatable about an axis; (c) a spring mechanism that is operatively attached to the spool and configured to urge the spool to rotate in a first rotational direction about the axis; (d) an electrically operated rotation regulator that is operatively attached to the spool and configured to, when activated, prevent the spool from rotating in the first rotational direction; (e) a sensor, external to the housing, configured to detect when an end portion of a cable is initially pulled away from the housing by detecting when a magnet in proximity to the sensor is pulled away from the sensor, the end portion of the cable being disposed outside of the housing, the magnet moving in conjunction with the end portion of the cable, (f) a circuit element configured to activate the rotation regulator in response to the sensor detecting the magnet being pulled away from the housing, wherein: (1) the housing initially retains within it a further portion of the cable that is contiguous with the end portion and coiled around the spool so that the pulling of the end portion of the cable away from the housing causes the further portion of the cable to begin being withdrawn from the housing and causes the spool to rotate in a second rotational direction about the axis that is opposite to the first rotational direction, and (2) the activation of the rotation regulator prevents the spring mechanism from causing the withdrawn part of the cable from being drawn back into the housing by preventing the spool from rotating in the first rotational direction; and (g) a switch configured to deactivate the rotation regulator, wherein at least one of: (1) the switch is configured to cause the rotation regulator to remain deactivated after operation of the switch so that the operation of the switch causes the spring mechanism to urge the spool to rotate in the first rotational direction until all of a previously pulled out portion of a cable is drawn back into the housing and coiled around the spool, or (2) the switch is configured to deactivate the rotation regulator only during operation of the switch and to re-activate the rotation regulator subsequent to the operation of the switch so that during operation of the switch, the spring mechanism urges the spool to rotate in the first rotational direction and causes part of a previously pulled out portion of a cable to be drawn back into the housing, and after the switch is operated, a remaining part of the previously pulled out portion of the cable remains external to the housing.

BRIEF DESCRIPTION OF DRAWINGS

The accompanying figures further illustrate the present embodiments.

The components in the drawings are not necessarily drawn to scale, emphasis instead being placed upon clearly illustrating the principles of the present embodiments. In the drawings, like reference numerals designate corresponding parts throughout the several views.

BRIEF DESCRIPTION OF THE SEVERAL VIEWS OF THE DRAWING

Figure 1A:
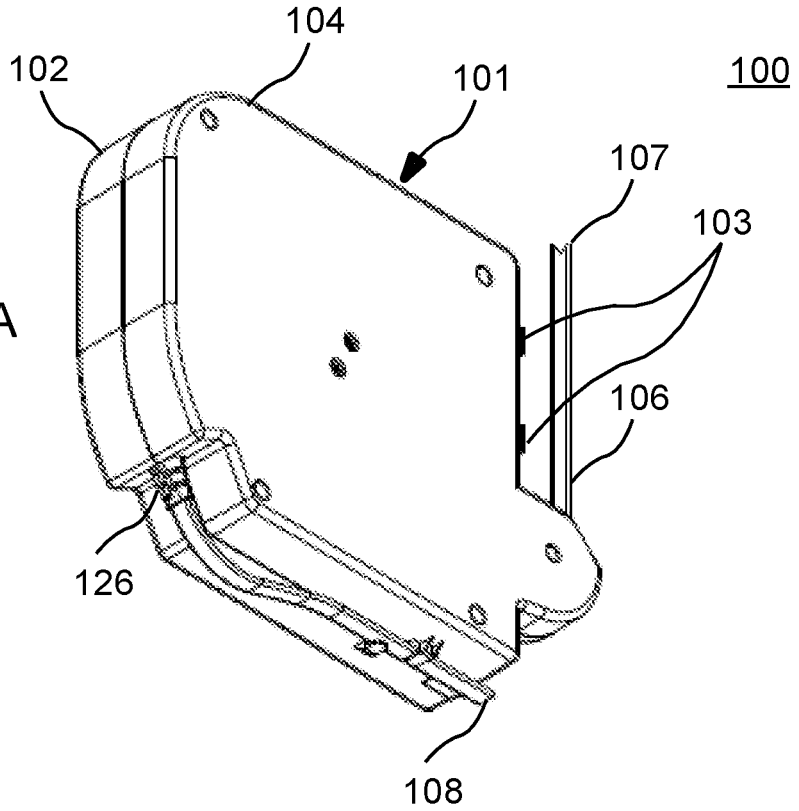
Figure 1B:
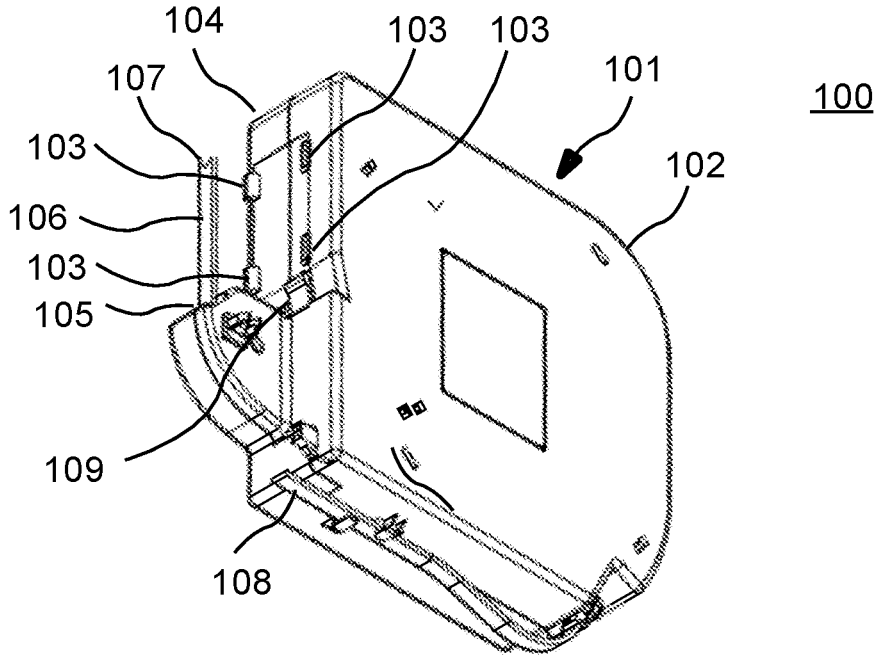
Figure 1C:
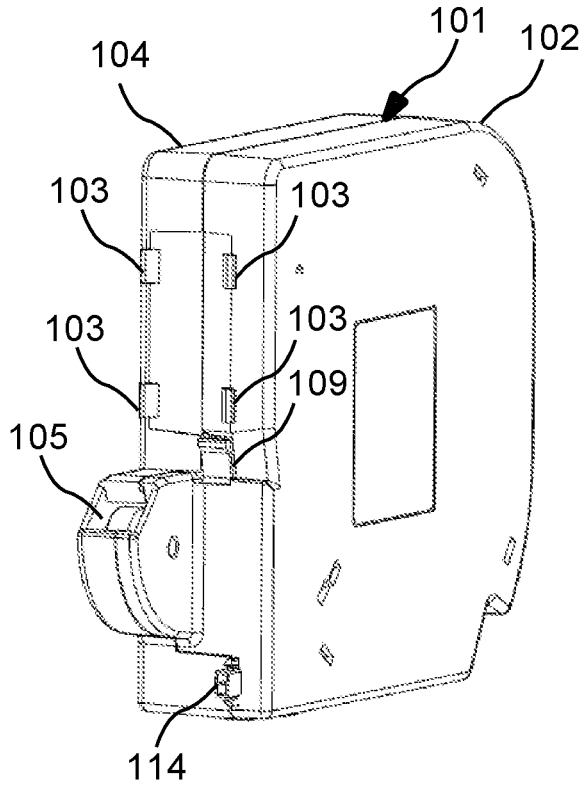
Figure 1D:
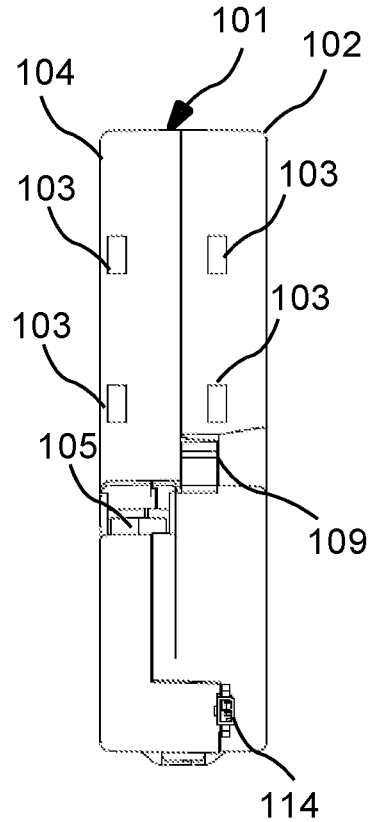

FIGS. 1A and 1B show side perspective views of a cable retractor housing in accordance with an embodiment, FIG. 1C shows a front perspective view of the cable retractor housing of FIGS. 1A and 1B, and FIG. 1D shows a front elevation view of the cable retractor housing of FIGS. 1A and 1B.

Figure 2:
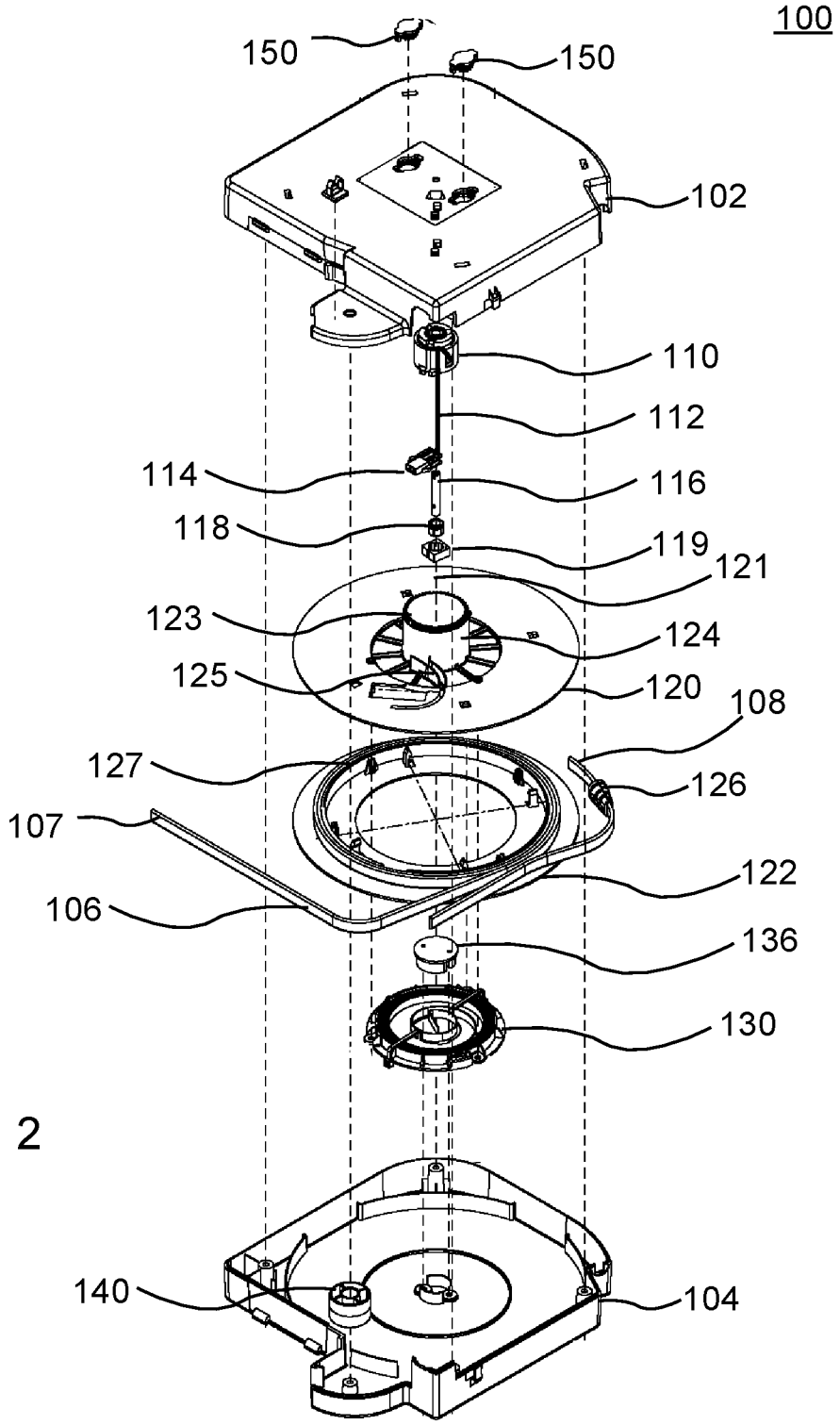

FIG. 2 depicts an exploded perspective view of a cable retractor in accordance with an embodiment.

Figure 3:
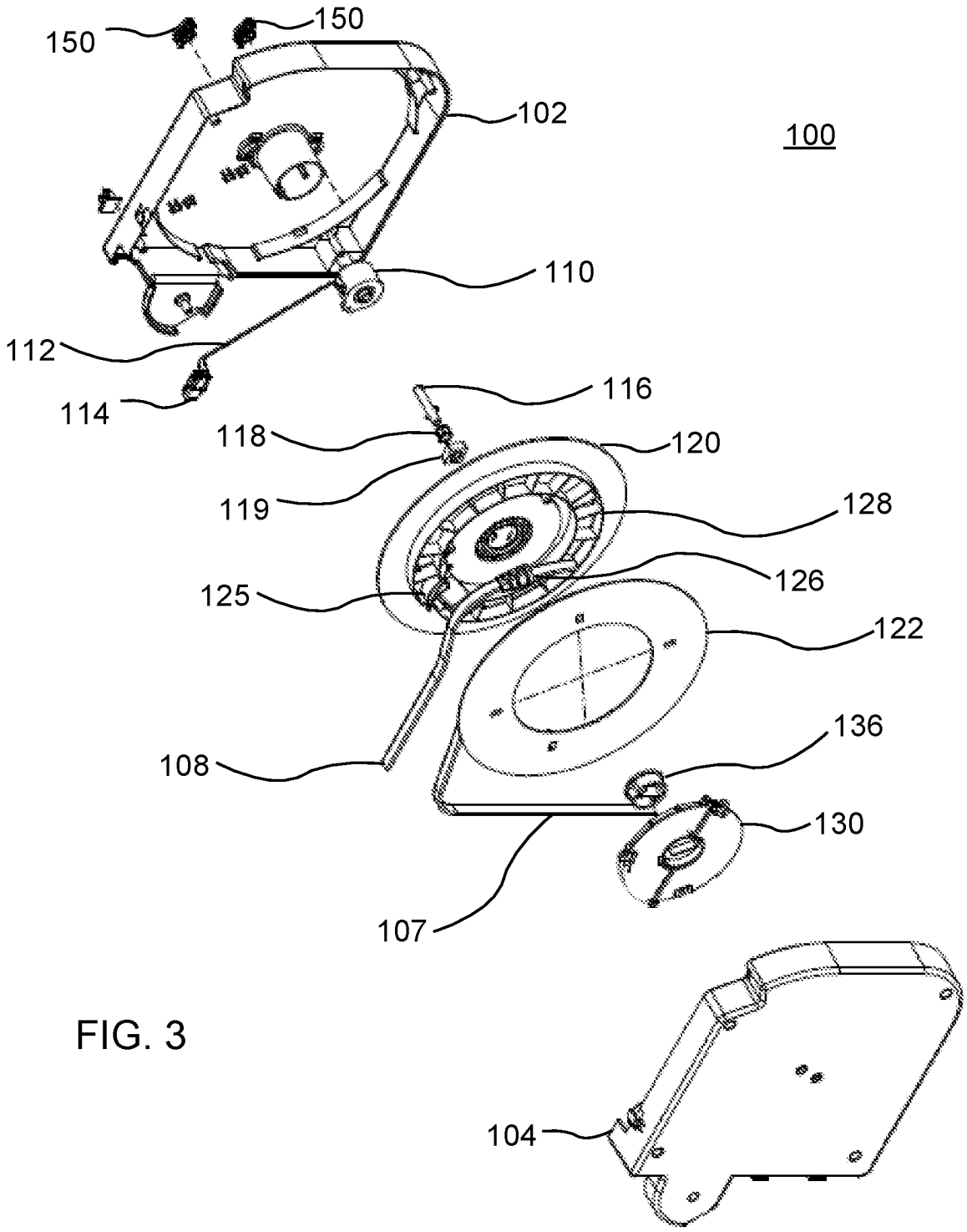

FIG. 3 illustrates another exploded perspective view of the cable retractor shown in FIG. 2.

Figure 4A:
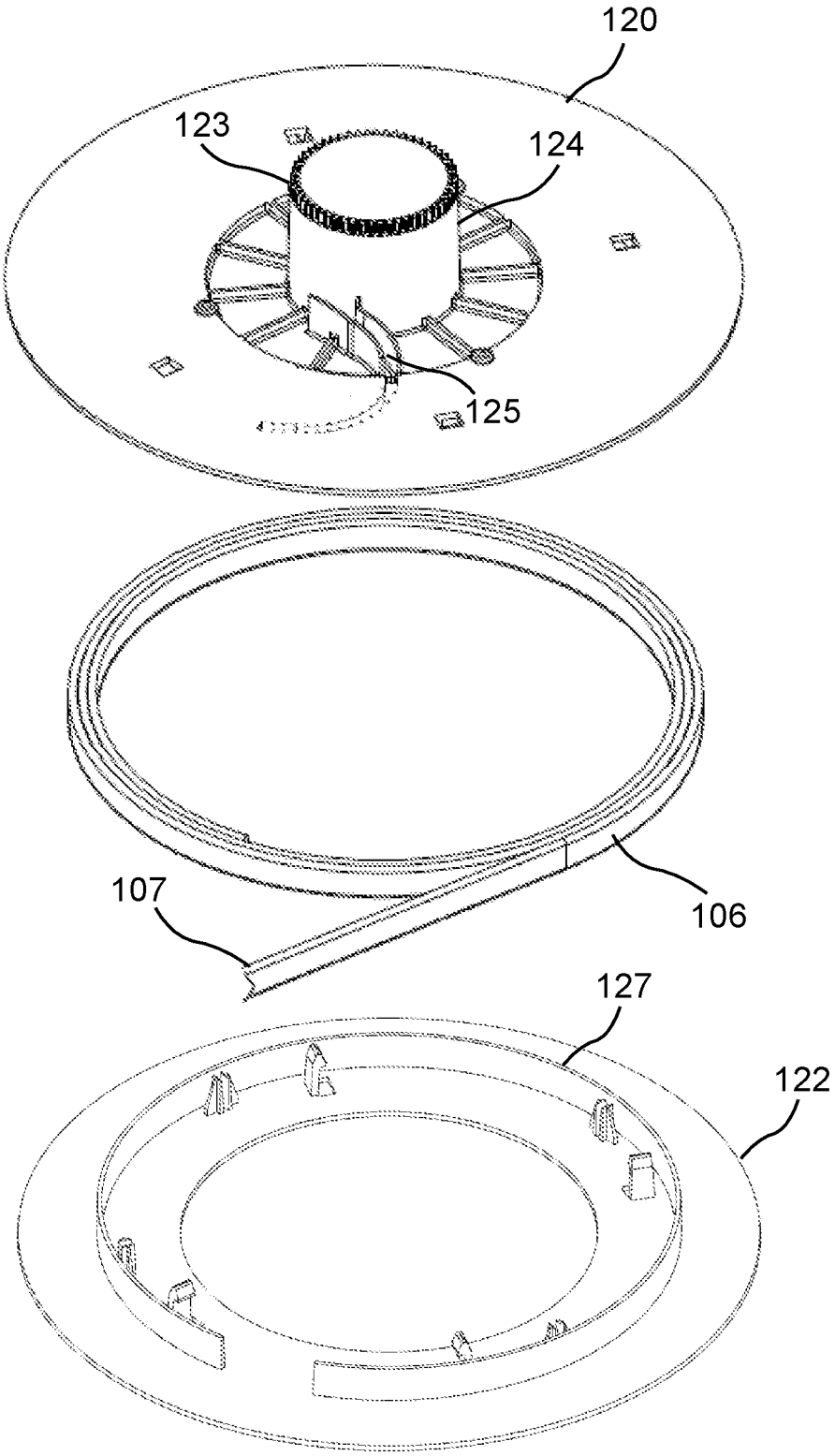
Figure 4B:
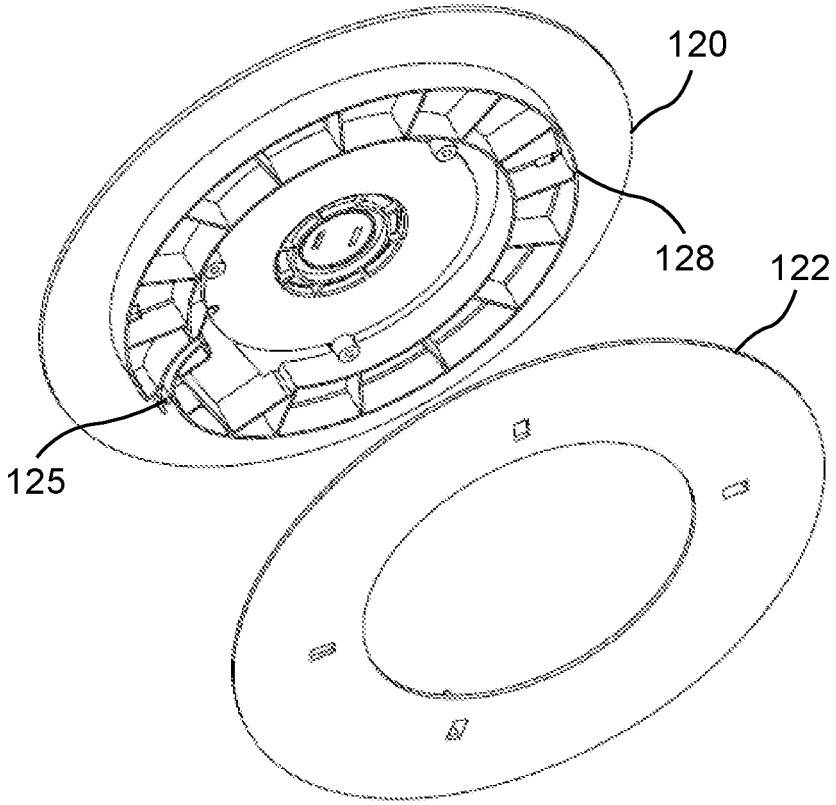
Figure 4C:
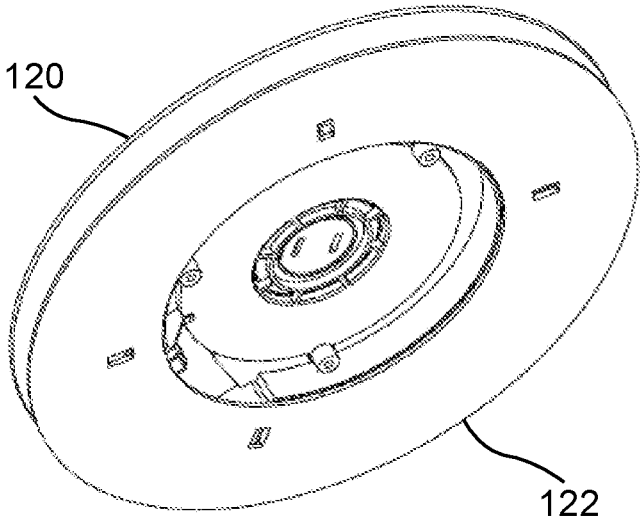
Figure 4D:
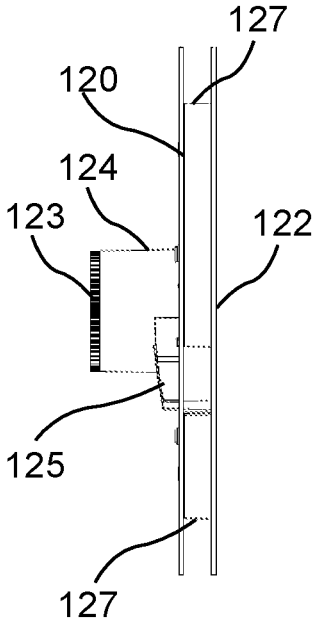

FIGS. 4A and 4B show exploded views of spool parts of a cable retractor in accordance with an embodiment, and FIGS. 4C and 4D show perspective and side elevation views, respectively, of the combined spool parts shown in FIGS. 4A and 4B.

Figure 5A:
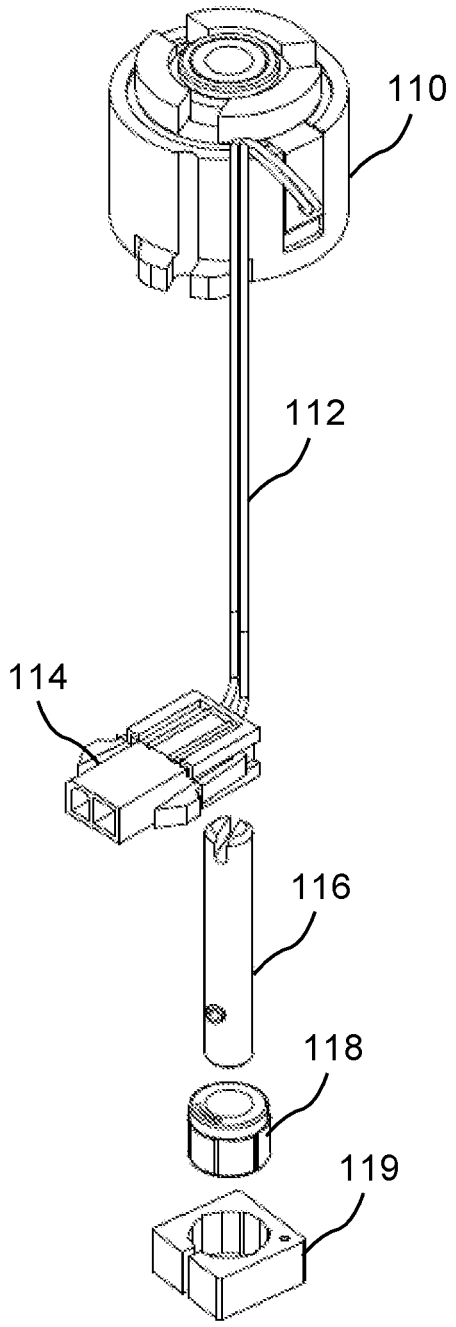
Figure 5B:
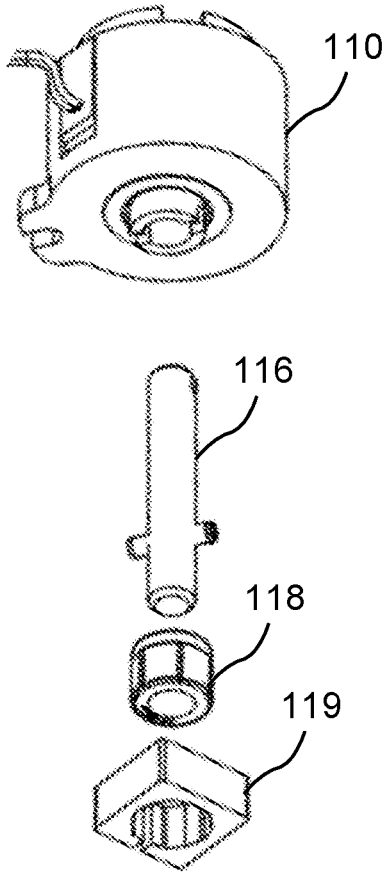

FIGS. 5A and 5B show exploded views of an electrically operated rotation regulator of a cable retractor in accordance with an embodiment.

Figure 6B:
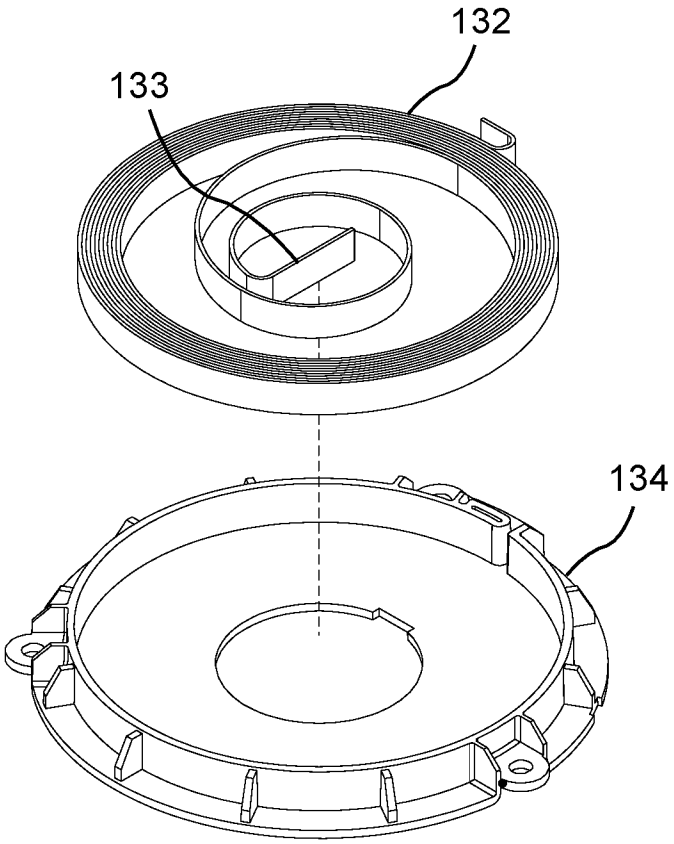
Figure 6A:
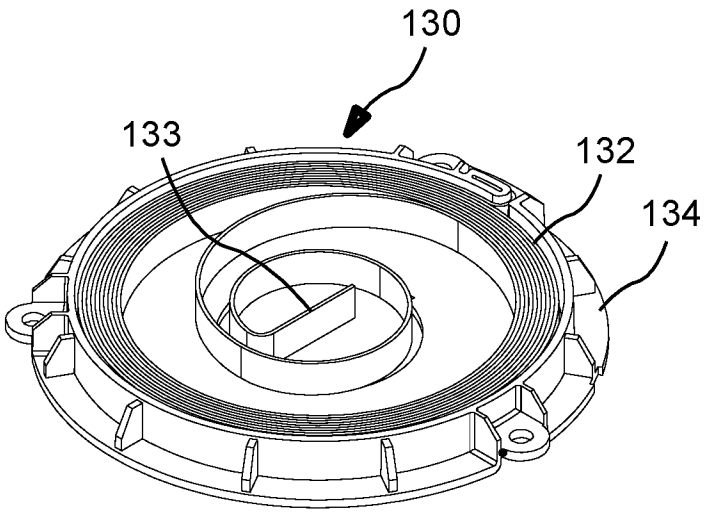

FIG. 6A shows a perspective view of a spring mechanism of a cable retractor in accordance with an embodiment; and FIG. 6B shows an exploded view of the spring mechanism shown in FIG. 6A.

Figure 7A:
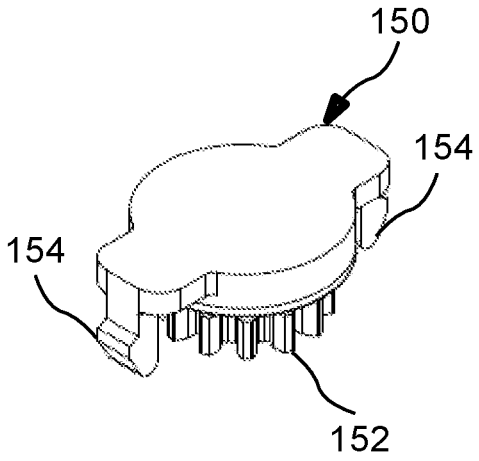
Figure 7B:
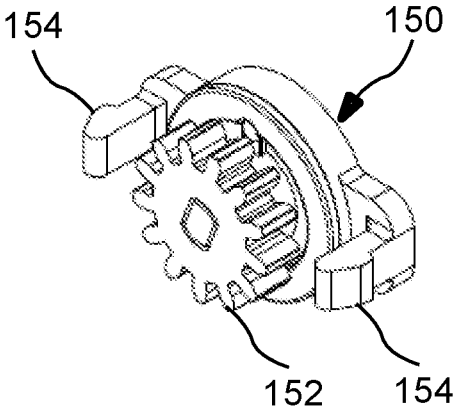

FIGS. 7A and 7B show top and side perspective views, respectively, of a dampener of a cable retractor in accordance with an embodiment.

Figure 8A:
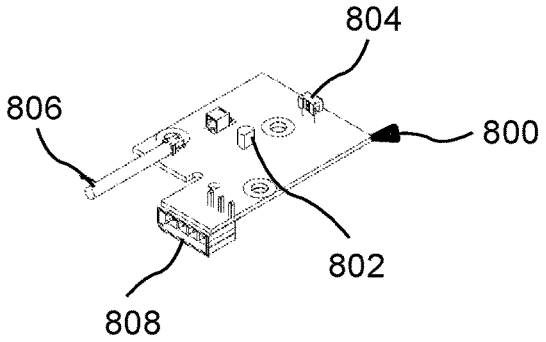
Figure 8B:
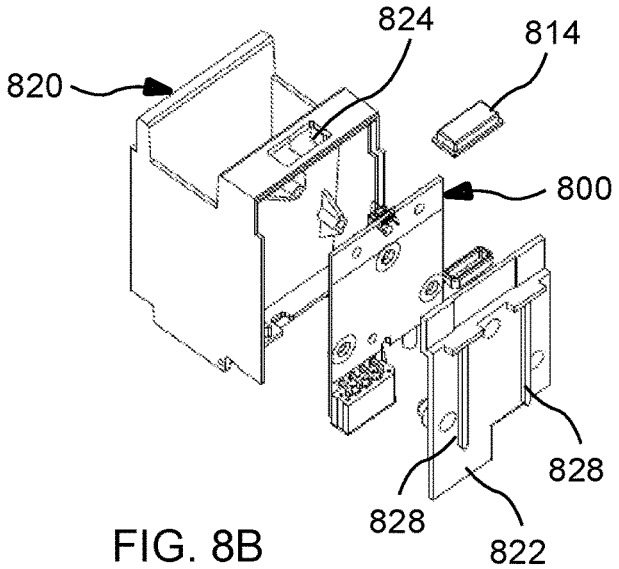
Figure 8C:
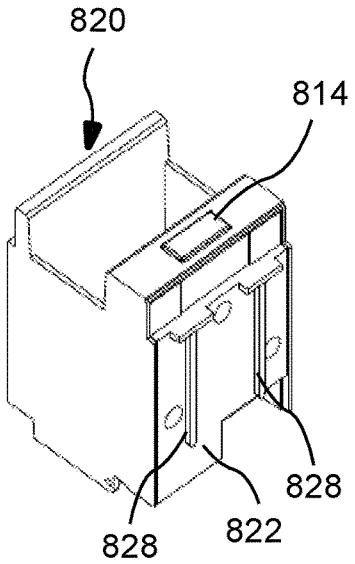
Figure 8D:
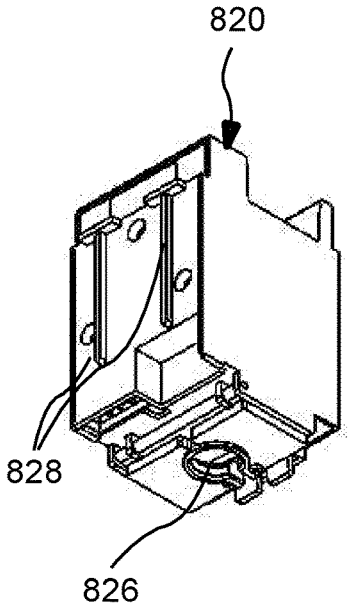

FIG. 8A shows a sensor and switching circuit board in accordance with an embodiment; and FIGS. 8B, 8C and 8D show exploded, top perspective, and bottom perspective views, respectively, of a module insert which incorporates the sensor and switching circuit board in accordance with an embodiment.

Figure 9A:
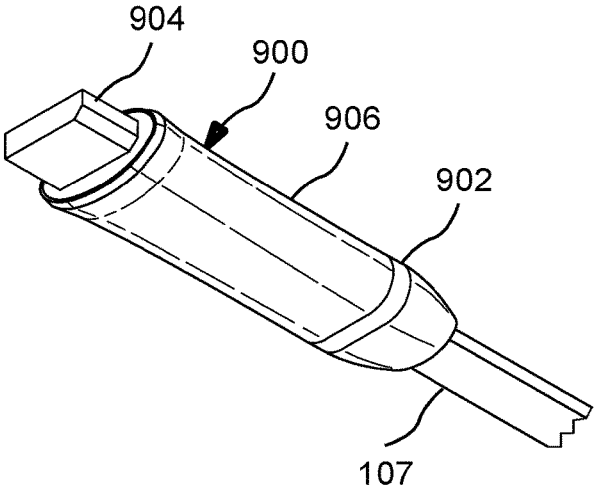
Figure 9B:
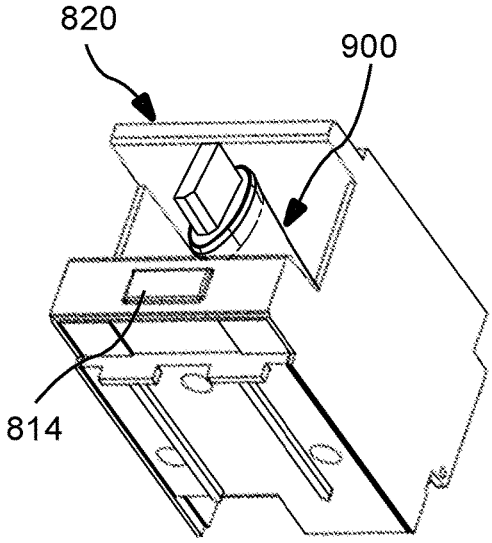
Figure 9C:
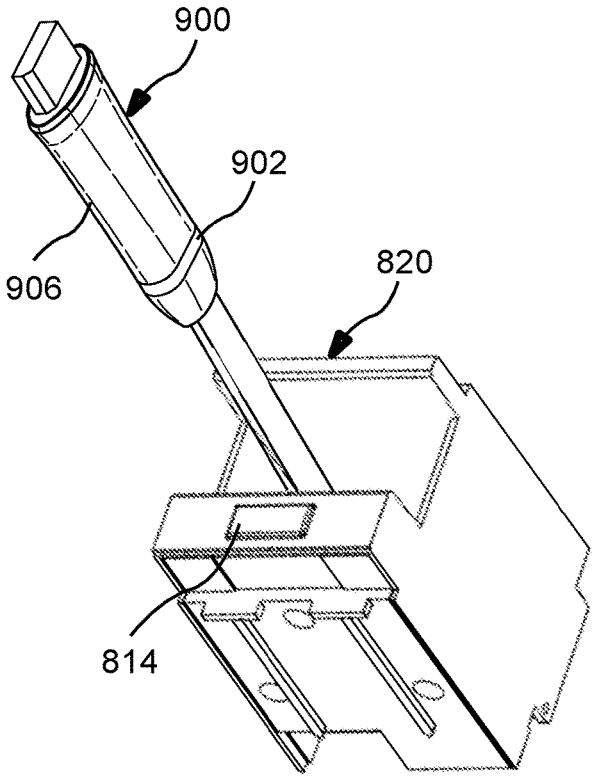

FIG. 9A shows a perspective view of a connector housing in accordance with an embodiment, and FIGS. 9B and 9C respectively show perspective views of a connector housing resting in, and partially withdrawn from, a module insert in accordance with an embodiment.

Figure 10A:
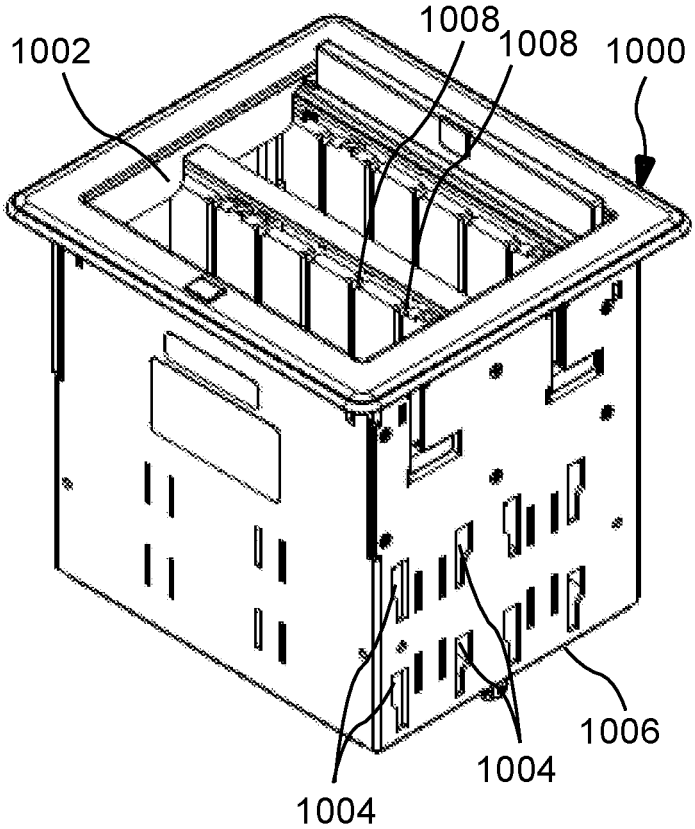
Figure 10B:
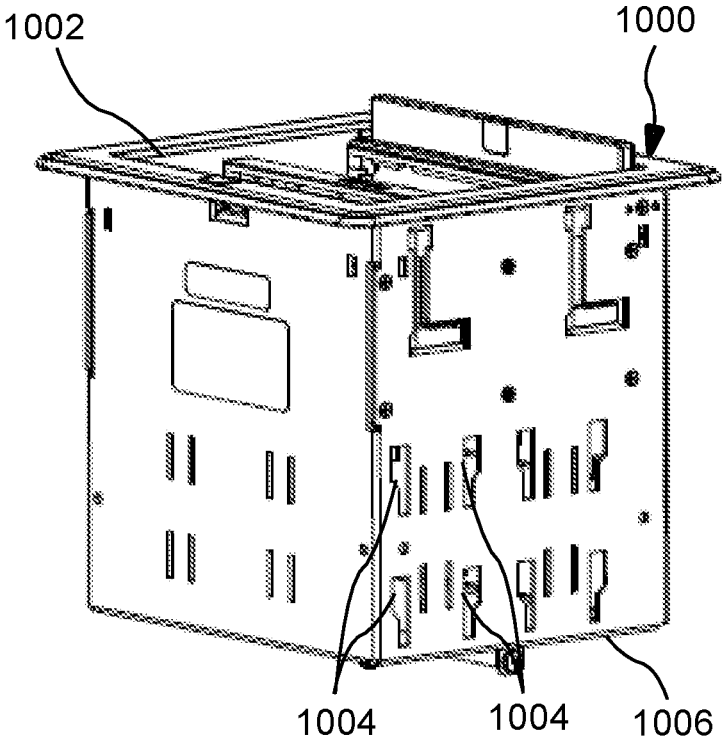

FIGS. 10A and 10B show top and side perspective views, respectively, of an example of a flip top unit.

Figure 11:
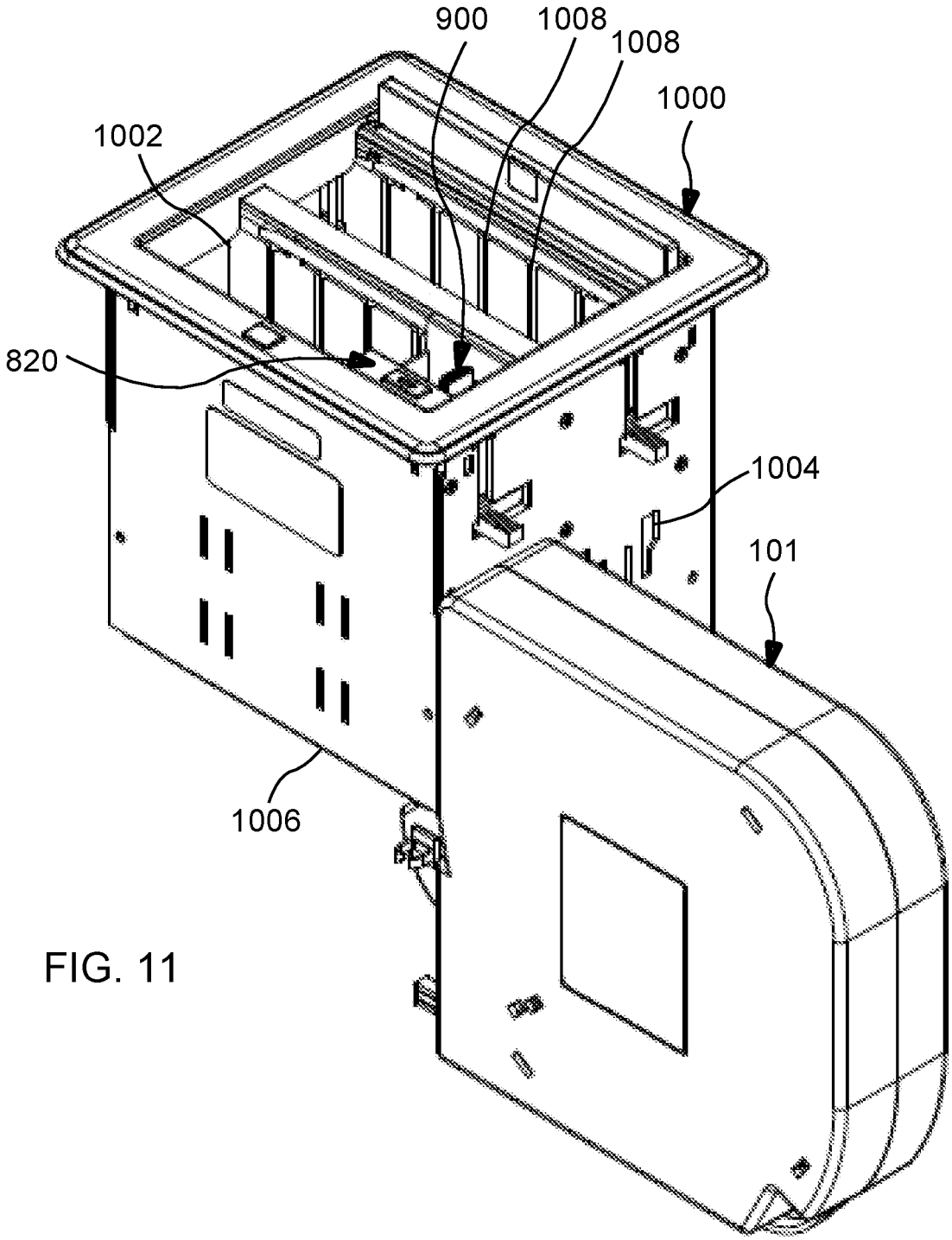

FIG. 11 shows a perspective view of an example of a flip top unit which incorporates a cable retractor and housing and a module insert in accordance with an embodiment.

DETAILED DESCRIPTION OF THE INVENTION

The present embodiments provide an improved cable retractor that uses an electrically controlled mechanism that permits any length of a continuous range of lengths of cable to be withdrawn from the cable retractor and that provides spring-driven retraction of the cable that can be initiated by a manual switch or a timer.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

LIST OF REFERENCE NUMBERS FOR THE MAJOR ELEMENTS IN THE DRAWING

The following is a list of the major elements in the drawings in numerical order.

100 retractor
101 housing
102 base of housing
103 hook
104 cover of housing
105 opening in housing
106 cable
107 free end portion of cable
108 fixed end portion of cable
109 snap connector
110 electromagnetic clutch mechanism
112 power supply cord
114 power supply connector
116 shaft
118 one-way bearing
119 square nut
120 first spool part
121 axis of rotation
122 second spool part
123 gear teeth
124 cylinder
125 curved channel
126 anchor
127 lip
128 lip
130 spring mechanism
132 spring
134 spring holder
140 roller
150 dampener
152 gear teeth
154 snap connector
800 sensor and switching circuit board
802 sensor
804 switch
806 power cord
808 power connector
814 switch cover
820 module insert
822 side cover
824 switch cover opening
826 bottom opening
828 guides

900 connector
902 magnet
904 connector terminal
906 connector housing
1000 flip top unit
1002 top opening
1004 side openings
1006 bottom surface
1008 guides

MODE(S) FOR CARRYING OUT THE INVENTION

The embodiment described herein in the context of a cable retractor, but is not limited thereto, except as may be set forth expressly in the appended claims.

Referring first to FIGS. 1A-1D, a housing 101 of a cable retractor 100 is depicted according to an embodiment. The housing 101 includes a base 102 and a cover 104. A cable 106 is primarily retained within the housing 101 but includes end portions that extend outside of the housing. A free end portion 107 of the cable 106 extends from an opening 105 in the housing 101. An additional portion of the cable 106 may be withdrawn from the housing 101 through the opening 105 by pulling the free end portion 107 of the cable 106 away from the housing 101, and the withdrawn portion of the cable 106 may be subsequently drawn back into the housing 101 through the opening 105. In an embodiment, the free end portion 107 of the cable 106 is physically joined at its end to an end of a connector housing, such as to a connector housing 906 of a connector 900 shown in FIG. 9, and the wiring disposed within the cable 106 is electrically coupled to a connector terminal located at an opposing end of the connector housing, such as to a connector terminal 904 of the connector 900 shown in FIG. 9.

An opposing end portion 108 of the cable 106 extends from another opening in the housing 101 and is affixed to the opening by an anchor 126. The fixed end portion 108 of the cable 106 further extends along, and is secured to, the housing 101 and then extends away from the housing for connection to an external data or power source.

The cable 106 may be configured to conform to one or more cabling and wiring standards, such as Universal Serial Bus (USB), Ethernet, power over Ethernet (PoE), 15-pin Video Graphics Array (VGA) (plus audio combined), High-Definition Multimedia Interface (HDMI), Digital Visual Interface (DVI), Category-5 (Cat-5), Category-5 Enhanced (Cat-5E), Category-6 (Cat-6), Augmented Category 6 (Cat-6a), optical fiber, audio, DisplayPort, or any other type of cable.

The cable 106 is preferably a flat cable, which coils more compactly within the housing than a round cable, but may alternatively be a round cable. Further, the cable 106 preferably includes two-layer jacketing. For example, the inner layer may be a PVC layer, and the outer layer may be a friction-reducing layer, such as a nylon or Teflon layer.

A front wall of the housing 101 further includes a plurality of hooks 103 for securing the housing onto a mounting surface having correspondingly located openings, such as to a sidewall of the box portion of a flip top unit. The housing 101 also includes a snap connector 109 for locking the housing in place after securing the housing onto the mounting surface. The snap connector 109 is shaped, for example, as an arm which extends outward at an angle from the front wall of the housing 101.

FIGS. 2 and 3 illustrate exploded perspective views of an embodiment of the cable retractor 100 shown in FIGS. 1A and 1B and in which various elements of the cable retractor are depicted.

The cable retractor 100 includes a first spool part 120 and a second spool part 122 which are rotatable about an axis 121. FIGS. 4A and 4B show in greater detail the first spool part 120 and the second spool part 122 depicted in FIGS. 2 and 3 in which like reference numerals depict like elements.

The first spool part 120 includes a cylinder part 124 that extends from a surface of the first spool part and which is concentric with the first spool part 120 and rotates together with the first spool part. A plurality of gear teeth 123 are disposed at one end of the cylinder part. A lip 128 extends from another surface of the first spool part 120. A curved channel 125 includes a part that extends inward from an opening formed in the first spool part 120 along the surface from which the cylinder part 124 extends. Another part of the curved channel 125 extends outward from the opening formed in the first spool part along the surface from which the lip 128 extends.

The second spool part 122 includes a lip 127 which extends from a surface of the second spool part 122 that faces the first spool part 120.

FIGS. 4C and 4D show perspective and side elevation views, respectively, of the first spool part 120 and the second spool part 122 when combined together to form a take-up spool. The lip 127 of the second spool part 122 has a larger diameter than the lip 128 of the first spool part 120 and surrounds the lip 128 of the second spool part 122, as FIG. 4D shows.

Referring back to FIGS. 2-3 and 4A-4B, the cable 106 includes a portion that is stored in the housing 101 by being coiled around the lip 128 of the first spool part 120. The coiled portion of the cable 106 is contiguous at one end with the free end portion 107 of the cable. Therefore, the coiled portion of the cable may be withdrawn from the housing 101 by pulling the free end portion 107 of the cable away from the housing 101 or by pulling a connector attached to the free end portion 107 of the cable away from the housing.

A further portion (not shown) of the cable is contiguous at one end with an opposing end of the coiled portion of the cable 106. Starting from opposing end of the coiled portion of the cable, the further portion of the cable extends along the outward part of the curved channel 125, through the opening in the first spool part 120, and then along the inward part of the curved channel 125. The further portion of the cable 106 is typically affixed at one or more of these locations to the first spool part 120. The further portion of the cable then extends around the drum part 124 and, typically, is wound in a direction opposite to that which the coiled portion of the cable 106 is wound around the spool. An opposing end of the further portion of the cable is then contiguous with the fixed end portion 108 of the cable at another opening in the housing where the fixed end portion 108 of the cable is held in place by the anchor 126.

When the coiled portion of the cable 106 is withdrawn from the housing 101, such as by pulling the free end portion 107 of the cable or a connector attached to the free end portion 107 of the cable away from the housing 101, the resulting rotation of the first and second spool parts 120 and 122 causes the further portion of the cable to uncoil from around the drum part 124 but remain loosely wound around the drum part 124. Because the further portion of the cable is fixed at one end to the first spool part 102 and at the opposing end to the housing 101, the further portion of the cable remains inside the housing 101 while the coiled portion of the cable 106 is withdrawn. When the withdrawn portion of the cable 106 is subsequently drawn back into the housing, such as by causing the first and second spool parts 120 and 122 to rotate in an opposite rotational direction, the withdrawn portion of the cable 106 is again coiled around the lip 127 of the second spool part 122. Concurrently, the rotation of the first spool part 120 causes the further portion of the cable 106 to again wind around the drum part 124.

Referring back to FIGS. 2 and 3, an electrically operated rotation regulator is disposed between the first spool part 120 and the base 102 of the housing 101. The electrically operated rotation regulator, when activated, permits the first and second spool parts 120 and 122 to turn about the axis 121 in a rotational direction that permits withdrawal of the coiled portion of the cable from the housing 101 but which prevents the first and second spool parts 120 and 122 from turning about the axis 121 in a rotational direction that would draw the cable 106 back into the housing.

In an embodiment, the electrically operated rotation regulator includes an electromagnetic clutch mechanism 110, or an analogous electrically operated device, a shaft 116, and a one-way bearing 118. The one-way bearing 118 is disposed at the center of the first spool part 120, such as by affixing the one-way bearing 118 to a square nut 119 that is held in a correspondingly shaped aperture (not shown) at the center of the cylinder part 124. The shaft 116 is affixed at one end to the one-way bearing and coincides with the rotational axis 121 of the first and second spool parts 120 and 122.

The electromagnetic clutch mechanism 110 is affixed to the base 102 of the housing 101 and includes an opening in which an opposing end of the shaft 116 is disposed. When the electromagnetic clutch mechanism 110 is activated, the electromagnetic clutch mechanism 110 engages the shaft 116 so that the first spool part 120 and second spool part 122 can only turn about the shaft 116 in the rotational direction permitted by the one-way bearing. That is, when the electromagnetic clutch mechanism 110 is activated, the one-way bearing 118 permits the first and second spool parts 120 and 122 to turn about the axis 121 in a rotational direction that would allow a portion of the cable 106 to be withdrawn from the housing but which prevents the first and second spool parts 120 and 122 from turning about the axis 121 in the opposite rotational direction which would draw the portion of the cable back into the housing. When the electromagnetic clutch mechanism 110 is not powered, the shaft 116 is decoupled from the rotation regulator, and the first and second spool parts 120 and 122 are not restricted from turning in either rotational direction. A power supply cord 112 and power supply connector 114 are connected to an external power supply which supplies power to activate the electromagnetic clutch mechanism 110.

FIGS. 5A and 5B show in greater detail the electromagnetic clutch mechanism 110, the shaft 116, the one-way bearing 118 and related elements depicted in FIGS. 2 and 3 in which like reference numerals depict like elements.

Though the electromagnetic clutch mechanism 110 is described, other electrically operated mechanisms may alternatively be used. For example, an electromagnetic brake or other electromagnetic device may be employed.

Referring back to FIGS. 2 and 3, the cable retractor 100 further includes a spring mechanism 130 having a spring 132 that is retained in and affixed to a spring holder 134. The spring holder 134, in turn, is secured to the second spool part 122. An end 133 of the spring 132 is coupled to the cover 104, such as using a hub 136. The spring mechanism 130 is configured such that rotation of the first and second spool parts 120 and 122 about the axis 121 increases the tension in the spring 132 and thereby increases the force exerted in an opposing rotational direction by the spring 132 on the first and second spool parts 120 and 122. FIGS. 6A and 6B show in greater detail the spring mechanism 130 in which like reference numerals depict like elements.

Referring again to FIGS. 2 and 3, the cable retractor 100 also includes a roller 140 for routing the cable 106 from around the first and second spool parts 120 and 122 to the opening 105. When a portion of the cable 106 is withdrawn from the housing 101, the portion of the cable 106 passes from the first and second spool parts 120 and 122, around the roller 140, and the outside the housing 101 through the opening 105.

The cable retractor 100 further includes a pair of dampeners 150. FIGS. 7A and 7B show an example of a dampener 150 in greater detail. Each dampener 150 includes gear teeth 152 and a pair of snap connectors 154. When the dampeners 150 are inserted into the openings in the base 102 of the housing 101, the snap connectors 154 secure the dampeners 150 to the base, and the gear teeth 152 of each dampener 150 engage the gear teeth 123 of the cylinder part 124 of the first spool part 120. The dampeners 150 serve to increase the rotational drag on the first and second spool parts 120 and 122 and thereby slow down the speed at which the cable 106 is drawn back into the housing.

FIGS. 8A-8D illustrate an example of an arrangement used for controlling operation of the electrically operated rotation regulator and, for example, for controlling operation of the electromagnetic clutch mechanism 110.

FIG. 8A shows a sensor and switching board 800 according to an embodiment. The sensor and switching board 800 includes a sensor 802 that detects when withdrawal of the coiled portion of the cable 106 from the housing 101 has been initiated. For example, the sensor may detect when the end portion 107 of the cable 106, or a connector attached to the end portion 108 of the cable 106, is first pulled away. When the sensor 802 senses that the end portion 107 has begun to be pulled away from the housing, circuitry in the sensor and switching board 800 causes the electrically operated rotation regulator to be activated.

FIG. 8B shows an exploded perspective view and FIGS. 8C and 8D show top and bottom perspective view, respectively, of an example of a module insert 820 into which the sensor and switching board 800 is employed, according to an embodiment. The sensor and switching board 800 may be located inside the module insert 820 and protected by a cover 822. The end portion 107 of the cable 106 passes through an opening 826 in the bottom of the module insert, and the end portion 107 of the cable 106, or a connector housing attached to the end portion 107 of the cable 106, may reside in the module insert 820 when the coiled portion of the cable 106 resides in the housing 101.

FIG. 9A illustrates an example of a connector 900 according to an embodiment. The connector 900 includes a connector housing 906 that is attached at one end to the end portion 107 of the cable 106. A connector terminal 904 is provided at the other end of the housing 906. The connector terminal 904 may be configured to conform to one or more cabling and wiring standards, such as Universal Serial Bus (USB Ethernet, power over Ethernet (PoE), 15-pin Video Graphics Array (VGA) (plus audio combined), High-Definition Multimedia Interface (HDMI), Digital Visual Interface (DVI), Category-5 (Cat-5), Category-5 Enhanced (Cat-5E), Category-6 (Cat-6), Augmented Category 6 (Cat-6a), optical fiber, audio, DisplayPort, or any other type of connector.

A magnet 902 is secured to the housing 906 and may be used for detecting when withdrawal of the coiled portion of the cable 106 from the housing 101 has been initiated by detecting movement of the magnet. FIGS. 9B and 9C illustrate an example in which the sensor and switching board 800 shown in FIG. 8A and the module insert 820 shown in FIGS. 8C and 8D are employed to detect when withdrawal of the cable from the housing has been initiated. When all but the end portions of the cable are stored in the housing 101, the connector 900 rests inside the module insert 820 at the bottom of the module insert, as shown in FIG. 9B. When the connector 900 is first pulled away from module insert 820, and hence when the cable 106 is first withdrawn from the housing 101, the sensor 802 detects that the magnet 902 has been pulled away, and upon such detection, the circuitry in the sensor and switching board 800 activates the rotation regulator which prevents the cable from being drawn back into the housing 101.

Referring back to FIG. 8A, the sensor and switching board 800 further includes a switch 804 by which the rotation regulator may be deactivated. Typically, after the rotation regulator is first activated by the circuitry in the sensor and switching board 800, the rotation regulator will remain activated until deactivated using the switch 804. Therefore, when a portion of the cable 106 is withdrawn from the housing 101, the continued operation of the activated rotation regulator prevents the spring mechanism from causing the first and second spool parts 120 and 122 to turn in the rotational direction that would draw the cable back into the housing.

The switch 804 and the circuitry in the sensor and switching board 800 may be configured to not only deactivate the rotation regulator while the switch is operated but also keep the rotation regulator turned off after the switch has been operated. Therefore, when a portion of the cable 106 has been withdrawn from the housing 101, the activation of the switch 804 causes the entire withdrawn portion of the cable to be pulled back into the housing 101.

Alternatively, the switch 804 and the circuitry in the sensor and switching board 800 may be configured to deactivate the rotation regulator while the switch is operated but to allow the rotation regulator to be re-activated when the switch is no longer operated. Therefore, when a portion of the cable 106 has been withdrawn from the housing 101, the return of part or all of the withdrawn portion of the cable back into the housing can only occur while the switch is operated, and after the switch is operated, a part of the withdrawn portion of the cable may remain outside the housing. The switch 804 may then be operated again to draw a further portion of the cable back into the housing or, alternatively, an additional portion of the cable may be pulled out of the housing. In this manner, the switch 804 may be repeatedly operated, followed possibly by withdrawing additional portions of the cable after each operation, until a desired length of the cable is disposed outside the housing 101.

The circuitry of the circuitry in the sensor and switching board 800 may be configured such that when the switch 804 is operated until all of the withdrawn portion of the cable is drawn back into the housing, and the sensor 802 detects the return of the connector to the module insert 820, the circuitry in the sensor and switching board 800 causes the rotation regulator to remain off even after the switch 804 is no longer operated.

The sensor and switching board 800 may also include a timer by which the rotation regulator may be deactivated after a predetermined interval from when a portion of the cable is withdrawn from the housing. Therefore, in the event that the withdrawn portion of the cable has not been drawn back using the switch 804 by that time, the timer will cause the withdrawn portion of the cable to be drawn back into the housing.

Alternatively, or additionally, a remote connection may be provided that permits the rotation regulator to be deactivated from a location external to the room where the cable connection is provided so that retraction of the cable is initiated from the remote location.

Referring again to FIGS. 8B and 8C, when the sensor and switching board 800 is employed within the module insert 820, the switch 804 is located beneath an opening 824. A switch cover 814 is disposed in the opening 824 and protects the switch 804.

FIGS. 10A and 10B show perspective views of an example of a flip top unit 1000 into which one or more of the cable retractors 100 and one or more of the module inserts 820 may be incorporated. The flip top unit 1000 includes an opening 1002 into which the module insert 820, or other types of module inserts, are received. Guides 1008 are provided which correspond to the guides 828 in the module insert 820 to allow for correct insertion of the module insert.

Side openings 1004 are provided in the sidewall of the box portion of the flip top unit 1000 for receiving the plurality of hooks 103 of the housing 101. The side openings 1004 correspond in location to the hooks 103 of the housing 101. Further, each side opening has a wider upper part and a narrower lower part. When the housing 101 is mounted onto the sidewall of the box portion of the flip top unit 1000, the hooks 103 are first inserted into the wider upper part of the openings 1004. Then, the housing 101 is slid along the sidewall until the hooks 103 engage the narrower lower part of the openings 1004 and press against the inside of the sidewall.

When the hooks 103 of the housing 101 are first inserted into the wider upper part of the openings 1004, the snap connector 109 is pushed back against the front wall of the housing 101 by the sidewall. When the hooks 103 of the housing 101 are then slid along the openings 1004 to their final position, the snap connector 109 moves past an end of the sidewall and then snaps outward to press against a bottom surface 1006 of the box portion and lock the housing 101 in place.

As a result of the housing 101 being mounted to the sidewall and locked in place, the opening 105 of the housing 101, from which the free end portion 107 of the cable extends, is located beneath the bottom surface 1006. The module insert 820 may be inserted into the opening 1002, and the free end portion 107 of the cable may be routed up through the bottom opening 826 of the module insert 820 to be accessible from above.

To dismount the housing 101 from the flip top unit 1000, the snap connector 109 is pressed away from the sidewall and toward the front wall of the housing 101 to unlock the snap connector 109. Then, the housing is slid along the openings in the mounting surface until the hooks 103 are clear of the narrow part of the openings. The housing 101 may then be moved away from the sidewall of the flip top unit 1000.

FIG. 11 shows an example of the flip top unit 1000 with the housing mounted to the sidewall of the box portion of the flip top unit 1000 and with corresponding module insert 820 disposed at a location in the opening 1002. Typically, the flip top unit 1000 is positioned in an opening cut into a table top or other surface where connections to electrical power and data services are needed. Only the opening and a surrounding bezel and door are visible from above the table surface, with the box portion of the flip top unit 1000 and the housing 101 being disposed below the table top.

An example of the operation of the cable retractor 100 is now described. When withdrawal of a portion of the cable 106 is initiated, such as by pulling the connector 900 away from the module insert 820, the sensor 802 in the sensor and switching board 800 detects, for example, that the magnet 902 has been pulled away, and upon such detection, the circuitry in the sensor and switching board 800 activates the rotation regulator. The pulling out of the portion of the cable 106 causes the first spool part 120 and second spool part 122 to turn about the axis 121 in a first rotational direction. The activation of the rotation regulator prevents the first and second spool parts 120 and 122 from turning about the shaft 116 in a second rotational direction that is opposite to the first rotational direction. Namely, the rotation regulator prevents the first and second spool parts 120 and 122 from turning in the rotational direction that would draw the portion of the cable back into the housing 101.

In an embodiment, the electromagnetic clutch mechanism 110 is activated and engages the shaft 116 so that the one-way bearing 118 only permits the first and second spool parts 120 and 122 to turn about the shaft 116 in the first rotational direction. That is, the one-way bearing 118 prevents the first spool part 120 and second spool part 122 from turning about the shaft 116 in the second rotational direction that is opposite to the first rotational direction.

As the first and second spool parts 120 and 122 are turned in the first rotational direction, the turning of the first and second spool parts 120 and 122 twists the end 133 of the spring 132 and increases the tension in the spring 132. That is, the turning of the first and second spool parts 120 and 122 in the first rotational direction increases the force exerted by the spring 132 in the second rotational direction on the first and second spool parts 120 and 122. The activated rotation regulator, however, prevents the first and second spool parts 120 and 122 from actually turning in the counter-direction. The rotation regulator remains activated after the cable is withdrawn to a desired length and further pulling out of the cable has stopped. The rotation regulator therefore continues to prevent the first and second spool parts 120 and 122 from turning in the second rotational direction and causing the withdrawn portion of the cable from being pulled back into the housing.

When the cable is to be subsequently retracted, the switch 804 is operated and deactivates the rotation regulator. In an embodiment, the electromagnetic clutch mechanism 110 is deactivated and decouples from the shaft 116. The deactivation of the rotation regulator permits the spring 132 to urge the first and second spool parts 120 and 122 to turn in the second rotational direction, causing the withdrawn portion of the cable to begin being pulled back into the housing 101. Depending on the configuration of the switch 804 and the circuitry in sensor and switching circuit board 800, the operation of the switch 804 may cause all of the withdrawn portion of the cable to be pulled back into the housing or only part of the withdrawn portion of the cable to be pulled back into the housing.

INDUSTRIAL APPLICABILITY

To solve the aforementioned problems, the present embodiments provide a cable retractor which uses an electrically operated rotation regulator, such as an electromagnetic clutch mechanism, to permit any desired length of the cable to be withdrawn and prevent return of the cable while the electrically operated rotation regulator is activated.

ALTERNATE EMBODIMENTS

Alternate embodiments may be devised without departing from the spirit or the scope of the embodiments.

What is claimed is:

1. A cable retractor comprising:

(a) a housing;

(b) a spool, disposed within the housing, that is mechanically coupled to the housing and rotatable about an axis in a first rotational direction by which a cable is wound around the spool and in a second rotational direction that is opposite to the first rotational direction and by which the cable is unwound from the spool;

(c) a spring mechanism operatively attached to the spool and configured to urge the spool to rotate in the first rotational direction;

(d) an electrically operated rotation regulator operatively attached to the spool and configured to, when activated, prevent the spool from rotating in the first rotational direction while permitting the spool to rotate in the second rotational direction, thereby permitting a portion of the cable to be unwound from the spool and preventing the portion of the cable from being rewound around the spool; and (e) a switch configured to deactivate the rotation regulator and cause the rotation regulator to remain deactivated after operation of the switch so that the operation of the switch causes the spring mechanism to urge the spool to rotate in the first rotational direction until all of a previously pulled out segment of the cable is drawn back into the housing.

2. The cable retractor of claim 1, wherein:

(a) the spool, the electrically operated rotation regulator, and the spring mechanism are disposed inside the housing; and (b) the switch is disposed external to the housing.

3. A cable retractor, comprising:

(a) a housing;

(b) a spool, disposed within the housing, that is mechanically coupled to the housing and rotatable about an axis in a first rotational direction by which a cable is wound around the spool and in a second rotational direction that is opposite to the first rotational direction and by which the cable is unwound from the spool;

(c) a spring mechanism operatively attached to the spool and configured to urge the spool to rotate in the first rotational direction;

(d) an electrically operated rotation regulator operatively attached to the spool and configured to, when activated, prevent the spool from rotating in the first rotational direction while permitting the spool to rotate in the second rotational direction, thereby permitting a portion of the cable to be unwound from the spool and preventing the portion of the cable from being rewound around the spool; and (e) a switch configured to deactivate the rotation regulator only during operation of that switch and to re-activate the rotation regulator subsequent to the operation of the switch so that (1) during operation of the switch, the spring mechanism urges the spool to rotate in the first rotational direction and causes a part of a previously pulled out segment of the cable to be drawn back into the housing, and (2) after the switch is operated, a remaining part of the previously pulled out segment remains external to the housing.

4. A cable retractor, wherein:

(a) a housing;

(b) a spool, disposed within the housing, that is mechanically coupled to the housing and rotatable about an axis in a first rotational direction by which a cable is wound around the spool and in a second rotational direction that is opposite to the first rotational direction and by which the cable is unwound from the spool;

(c) a spring mechanism operatively attached to the spool and configured to urge the spool to rotate in the first rotational direction; and (d) an electrically operated rotation regulator operatively attached to the spool and configured to, when activated, prevent the spool from rotating in the first rotational direction while permitting the spool to rotate in the second rotational direction, thereby permitting a portion of the cable to be unwound from the spool and preventing the portion of the cable from being rewound around the spool, wherein:

(e) an outer surface of the housing includes a plurality of hooks configured to engage corresponding openings in a surface upon which the housing is mounted.

5. The cable retractor of claim 4, wherein:

(a) the outer surface of the housing includes a snap connector configured to secure the housing to an edge of the surface.

6. A cable retractor, comprising:

(a) a housing;

(b) a spool, disposed within the housing, that is mechanically coupled to the housing and rotatable about an axis in a first rotational direction by which a cable is wound around the spool and in a second rotational direction that is opposite to the first rotational direction and by which the cable is unwound from the spool;

(c) a spring mechanism operatively attached to the spool and configured to urge the spool to rotate in the first rotational direction about the axis;

(d) a one-way bearing coupled to the spool and configured to rotate only in the second rotational direction about the axis;

(e) a shaft coupled at one end to the one-way bearing; and (f) an electromagnetic clutch coupled to the housing and configured to, when activated, engage an opposing end of the shaft whereby the one-way bearing prevents the spool from rotating in the first rotational direction while permitting the spool to rotate in the second rotational direction, thereby permitting a portion of the cable to be unwound from the spool and preventing the portion of the cable from being rewound around the spool, wherein;

(1) withdrawing a segment of the cable from inside the housing activates the electromagnetic clutch and prevents the pulled out segment from being drawn back into the housing; and (g) a switch configured to deactivate the electromagnetic clutch and cause the electromagnetic clutch to remain deactivated after operation of the switch so that the operation of the switch causes the spring mechanism to urge the spool to rotate in the first rotational direction until all of the pulled out segment of the cable is drawn back into the housing.

7. A cable retractor, comprising:

(a) a housing;

(b) a spool, disposed within the housing, that is mechanically coupled to the housing and rotatable about an axis in a first rotational direction by which a cable is wound around the spool and in a second rotational direction that is opposite to the first rotational direction and by which the cable is unwound from the spool;

(c) a spring mechanism operatively attached to the spool and configured to urge the spool to rotate in the first rotational direction about the axis;

(d) a one-way bearing coupled to the spool and configured to rotate only in the second rotational direction about the axis;

(e) a shaft coupled at one end to the one-way bearing; and (f) an electromagnetic clutch coupled to the housing and configured to, when activated, engage an opposing end of the shaft whereby the one-way bearing prevents the spool from rotating in the first rotational direction while permitting the spool to rotate in the second rotational direction, thereby permitting a portion of the cable to be unwound from the spool and preventing the portion of the cable from being rewound around the spool, wherein;

(1) withdrawing a segment of the cable from inside the housing activates the electromagnetic clutch and prevents the pulled out segment from being drawn back into the housing; and (g) a switch configured to deactivate the electromagnetic clutch and during operation of that switch and to re-activate the electromagnetic clutch subsequent to the operation of the switch so that (1) during operation of the switch, the spring mechanism urges the spool to rotate in the first rotational direction and causes part of the pulled out segment of the cable to be drawn back into the housing, and (2) after the switch is operated, a remaining part of the pulled out segment remains external to the housing.

8. A cable retractor, comprising:

(a) a housing;

(b) a spool, disposed within the housing, that is mechanically coupled to the housing and rotatable about an axis in a first rotational direction by which a cable is wound around the spool and in a second rotational direction that is opposite to the first rotational direction and by which the cable is unwound from the spool;

(c) a spring mechanism operatively attached to the spool and configured to urge the spool to rotate in the first rotational direction;

(d) an electrically operated rotation regulator operatively attached to the spool and configured to, when activated, prevent the spool from rotating in the first rotational direction while permitting the spool to rotate in the second rotational direction, thereby permitting a portion of the cable to be unwound from the spool and preventing the portion of the cable from being rewound around the spool; and (e) a switch configured to deactivate the rotation regulator.

9. The cable retractor of claim 8, wherein:

(a) withdrawing a segment of the cable from inside the housing activates the rotation regulator and prevents the pulled out segment from being drawn back into the housing; and (b) the switch is configured to cause the rotation regulator to remain deactivated after operation of the switch so that the operation of the switch causes the spring mechanism to urge the spool to rotate in the first rotational direction until all of the pulled out segment of the cable is drawn back into the housing.

10. The cable retractor of claim 8, wherein:

(a) withdrawing a segment of the cable from inside the housing activates the rotation regulator and prevents the pulled out segment from being drawn back into the housing; and (b) the switch is configured to deactivate the rotation regulator only during operation of that switch and to re-activate the rotation regulator subsequent to the operation of the switch so that (1) during operation of the switch, the spring mechanism urges the spool to rotate in the first rotational direction and causes part of the pulled out segment of the cable to be drawn back into the housing, and (2) after the switch is operated, a remaining part of the pulled out segment remains external to the housing.

11. The cable retractor of claim 8, wherein:

(a) the spool, the electrically operated rotation regulator, and the spring mechanism are disposed inside the housing; and (b) the switch is disposed external to the housing.

12. The cable retractor of claim 8, wherein:

(a) the electrically operated rotation regulator further comprises an electromagnetic clutch coupled to the housing.

13. The cable retractor of claim 12, further comprising:

(a) a one-way bearing coupled to the spool and configured to rotate only in the second rotational direction; and (d) a shaft coupled at one end to the one-way bearing; wherein (e) the electromagnetic clutch, when activated, engages an opposing end of the shaft whereby the one-way bearing prevents the spool from rotating in the first rotational direction.

* * * * *